US010494906B2

(12) United States Patent
Nandola et al.

(10) Patent No.: US 10,494,906 B2
(45) Date of Patent: Dec. 3, 2019

(54) METHOD AND A CONTROL SYSTEM FOR OPTIMIZING PRODUCTION OF A HYDROCARBON WELL

(71) Applicant: ABB Schweiz AG, Baden (CH)

(72) Inventors: Nareshkumar Nandola, Bangalore (IN); Niket Kaisare, Bangalore (IN); Arun Gupta, Mumbai (IN)

(73) Assignee: ABB Schweiz AG, Baden (CH)

( * ) Notice: Subject to any disclaimer, the term of this patent is extended or adjusted under 35 U.S.C. 154(b) by 168 days.

(21) Appl. No.: 15/531,250

(22) PCT Filed: Nov. 30, 2015

(86) PCT No.: PCT/IB2015/059214
§ 371 (c)(1),
(2) Date: May 26, 2017

(87) PCT Pub. No.: WO2016/084058
PCT Pub. Date: Jun. 2, 2016

(65) Prior Publication Data

US 2017/0356279 A1 Dec. 14, 2017

(30) Foreign Application Priority Data

Nov. 30, 2014 (IN) ..... 5994/CHE/2014

(51) Int. Cl.
*E21B 43/12* (2006.01)
*E21B 34/06* (2006.01)
(Continued)

(52) U.S. Cl.
CPC ..... *E21B 43/128* (2013.01); *E21B 34/06* (2013.01); *E21B 41/0092* (2013.01);
(Continued)

(58) Field of Classification Search
CPC .... E21B 43/128; E21B 34/06; E21B 41/0092; E21B 43/168; E21B 47/04; E21B 47/06; E21B 12/00; E21B 44/00
See application file for complete search history.

(56) References Cited

U.S. PATENT DOCUMENTS 4,442,710 A 4/1984 Meng
4,738,313 A 4/1988 McKee
(Continued)

FOREIGN PATENT DOCUMENTS

CN 2621219 Y 6/2004
CN 203685148 U 7/2014
(Continued)

OTHER PUBLICATIONS

International Preliminary Report on Patentabiltiy, International Application No. PCT/IB2015/059214, dated Jun. 6, 2017, 7 pages.
(Continued)

*Primary Examiner* — Yong-Suk Ro
(74) *Attorney, Agent, or Firm* — Barnes & Thornburg LLP

(57) ABSTRACT

Methods and control systems for optimizing production of a hydrocarbon well with a local controller in communication with a supervisory control and data acquisition (SCADA) system are disclosed. The presently disclosed methods may include calculating, at the local controller, optimal targets for one or more well parameters using measured values associated with operation of the hydrocarbon well; obtaining, at the local controller, a model that comprises a relationship between an operation of a gas injection choke and an operation of a production choke with the one or more well parameters based on the measurement values and received model parameters from the SCADA system; determining, at the local controller, operating set points based on the model for control of at least one of the production choke and the gas
(Continued)

injection choke; and operating at least one of the production choke and the gas injection choke for optimized production.

9 Claims, 5 Drawing Sheets

(51) Int. Cl.

| | |
|---|---|
| ***E21B 41/00*** | (2006.01) |
| ***E21B 43/16*** | (2006.01) |
| ***E21B 47/04*** | (2012.01) |
| ***E21B 47/06*** | (2012.01) |
| *E21B 12/00* | (2006.01) |
| *E21B 44/00* | (2006.01) |

(52) U.S. Cl.
CPC ..... *E21B 43/168* (2013.01); *E21B 47/04* (2013.01); *E21B 47/06* (2013.01); *E21B 12/00* (2013.01); *E21B 44/00* (2013.01)

(56) References Cited

U.S. PATENT DOCUMENTS

| | | | |
|---|---|---|---|
| 4,921,048 | A | 5/1990 | Crow et al. |
| 5,634,522 | A | 6/1997 | Hershberger |
| 5,785,123 | A | 7/1998 | Lea, Jr. |
| 5,871,048 | A | 2/1999 | Tokar et al. |
| 6,241,014 | B1 | 6/2001 | Majek et al. |
| 6,758,277 | B2 | 7/2004 | Vinegar et al. |
| 7,953,584 | B2 | 5/2011 | Rashid |
| 2002/0029883 | A1 | 3/2002 | Vinegar et al. |
| 2003/0145986 | A1 | 8/2003 | Evans et al. |
| 2007/0012442 | A1 | 1/2007 | Hearn |
| 2008/0154564 | A1 | 6/2008 | Rashid |
| 2008/0262736 | A1* | 10/2008 | Thigpen ..... E21B 43/128 702/9 |
| 2009/0200020 | A1 | 8/2009 | Hearn |
| 2012/0095603 | A1* | 4/2012 | Rashid ..... E21B 43/00 700/282 |
| 2013/0071262 | A1 | 3/2013 | Men |

FOREIGN PATENT DOCUMENTS

| | | | |
|---|---|---|---|
| EP | 756065 | A1 | 1/1997 |
| EP | 1028227 | A1 | 8/2000 |
| WO | 00/00715 | A1 | 1/2000 |
| WO | 2013/188090 | A1 | 12/2013 |

OTHER PUBLICATIONS

International Search Report, International Application No. PCT/IB2015/059214, dated Jan. 27, 2016, 4 pages.
Written Opinion of the International Searching Authority issued in connection with International Application No. PCT/IB2015/059214, dated Jan. 27, 2016, 6 pages.

* cited by examiner

METHOD AND A CONTROL SYSTEM FOR OPTIMIZING PRODUCTION OF A HYDROCARBON WELL

CROSS-REFERENCE TO RELATED APPLICATIONS

This application is a U.S. national stage of International Application Serial No. PCT/IB2015/059214, filed Nov. 30, 2015, which claims priority to Indian Patent Application No. 5994/CHE/2014, filed Nov. 30, 2014. The entire disclosures of both of the foregoing applications are hereby incorporated by reference.

FIELD OF THE INVENTION

The invention generally relates to the field of hydrocarbon wells, and relates more specifically to a method and control system for optimizing production of the hydrocarbon well, particularly gas-lifted hydrocarbon wells.

BACKGROUND

In hydrocarbon wells used for the production of hydrocarbons from reservoirs, a gas-lift technique is a widely used artificial lift technique to produce oil and gas from wells. In a typical hydrocarbon well operation, with time, the reservoir pressure reduces and liquids (i.e. oil, water and condensate) accumulate at the well bottom, which hinders natural flow of gas and liquids to the surface. A gas-lift method using gas injection in the hydrocarbon well is used to remove these liquids so that bottom-hole pressure reduces and flow from reservoir to the well-bottom takes place.

In particular, part of produced gas from the hydrocarbon production (that includes both gas and liquid), is compressed and re-injected to the well bottom via a mandrel system. In the mandrel system, mandrel acts as a valve between annulus and tubing, which allows gas flow. The resulting low density mixture of liquid and gas, (gas bubble in liquid or liquid droplets in gas), reduces the overall density of the mixture that leads to reducing the bottom-hole pressure of the well and allows the well to flow properly.

Production of liquid (e.g. oil) and gas, jointly being referred here as hydrocarbon, from such gas-lifted wells is a function of the rate of gas injection (injection choke opening), rate of production (production choke opening), depth at which gas is injected (mandrel position) as well as reservoir characteristics.

One class of methods for gas lift control presented in literature, involves regulation of the system to the desired operating condition by manipulating gas injection choke. These include either simple controller like PID (proportional-integral-derivative controller) or model-based controllers. The former does not take future dynamics and disturbances into account. The latter uses first principles model based approach, accuracy of which is highly depends on how detailed the model is and most of the time it is computationally intractable for real time control.

Another class of methods, aim at driving the well to an economic optimum (either maximizing profit or maximizing oil production). Herein, either first principles model are used, or statistical data-based models are built to obtain a generic production curve. Then the problem mainly reduces to operating at the optimal point, or using some gradient based method to move towards that point. Some such control approaches are available in the patent literature as listed below.

Patent document EP0756065A1 proposes production control of gas-lifted well using pressure variation based dynamic control (PID) via production and injection choke manipulation. Method for developing statistical model of well production behavior and its use for control is addressed in patent document EP1028227A1. A method for operating gas lift wells based on IPR (inflow performance relationship), curve and pressure vs. production rate relations (one for each parameter) based operating scheme is proposed in U.S. Pat. No. 4,442,710. The rule based production scheme based on ratio between gas injection and liquid production to maximize liquid production is addressed in U.S. Pat. No. 4,738,313 while rule based control based on comparison of optimal gas-lift slope with one variable is addressed in U.S. Pat. No. 5,871,048. Use of neural network based multiphase flow regime model, which is trained using downhole data, to change gas injection rate is documented in U.S. Pat. No. 6,758,277B2. Various methods for optimal allocation of gas injection among multiple wells is addressed in U.S. Pat. No. 7,953,584B2 and US20080154564A1.

There is a need for a method that overcomes the challenge of addressing dynamic changes in the well operation for optimizing the hydrocarbon production quickly. The controllers (local computing devices) have less computational power to handle large operational data, and the turnaround time for control data from any central control system such as a supervisory control and data acquisition system (SCADA) to the controllers is very long due to communication protocols to handle the dynamic changes.

Further, from an operational viewpoint, maximum production from the hydrocarbon well is achieved when the operating valve, i.e. lower most mandrel valve (106), is open and unloading valves (107) are closed, as shown in FIG. 1. However, it is not always possible to operate with lowermost valve open. Due to various disturbances entering the system either from injection or line pressure, or from well irregularities, the continuous gas lift operation may be disturbed and open mandrel valve may change from operating valve to unloading valve.

As limited information/measurements are available in practice, which include surface measurements such as injection pressure, line pressure, tubing pressure and casing pressure, the knowledge of which mandrel valve is open is missing. In absence of direct measurement on mandrel valve operation, there is no accurate way to identify which valve is open or close. This presents the operating challenge on how much gas to inject via the gas injection choke and how to switch back to lowest mandrel operation via operation of production choke.

There are known methods to estimate flow regimes in tubing and model based approach for design of gas well unloading. These methods can primarily be used to improve design of unloading wells and does not deal with the operation of well. Several of the prior art methods use an inherent assumption that is the flow of annulus gas to the tubing is through the operating valve, i.e. lower most valve, and other valves (if any) remain closed. With this assumption, most of the state-of-the-art production models consider a single mandrel well.

Thus, these methods may not be applicable to the situation where the liquid loads up during dynamic well operation, as explained herein. During a gas lift start-up or manual unloading of the well, the operator typically uses heuristics based on best practice. API RP 11V5 standard details the required recommended practice for operation, maintenance, and troubleshooting gas lift installations. During the startup, the operating mandrel switch between different mandrels and when the operator assumes that optimal mandrel operation is reached, he or she operators operate the well in auto mode. This is done by injecting the gas in annulus to depreciate the liquid level in annulus and enabling the next lower mandrel valve to operate till the last operating valve is reached. This operation is also known as unloading well. Now, during the normal operation, if due to any disturbance, a switch of the operating mandrel from the lower most mandrel to an unloading mandrel happens, the hydrocarbon flow from the well is adversely affected leading to lower production and higher gas injection cost.

Besides, the above issues of controlling the gas injection choke and the production choke, identifying accurate unloading or operating valve, the control of gas lift operation in onshore unconventional fields (e.g., shale gas) presents some unique challenges due to reservoir characteristics, and due to the fact that these wells are often less instrumented compared to conventional oil wells. With different reservoir characteristics the system and methods available for conventional oil wells are not applicable in shale gas wells or in general unconventional reservoirs.

OBJECTS OF THE INVENTION

As explained herein above there is a need for providing a control system and method for optimal operation of the gas-lifted hydrocarbon well that adjusts to dynamic behavior of the hydrocarbon well. Further there is a need for dynamic estimation of whether the unloading valve or operating valve is open. And this estimation if based on only on surface measurements, would be highly advantageous, as the actual well equipment need not tempered with, and is one of the objects of the invention.

It is an object of the invention to address the above needs by providing a control system and method that allows for dynamically changing the opening of production valve and injection valve for optimal production.

Another object of the invention is to provide a method to identify the operating mode (all unloading valves closed) or unloading mode (one of the unloading valves is open) at the right time.

SUMMARY OF THE INVENTION

In one aspect, the invention provides a method for optimizing production of a hydrocarbon well with a local controller supported from a supervisory control and data acquisition (SCADA) system. The SCADA system manages a plurality of hydrocarbon wells and also acquires operation data of the hydrocarbon well from the local controller. The hydrocarbon well comprises a production choke to control production of hydrocarbon from the hydrocarbon well, and a gas injection choke to control gas injection in an annulus of the hydrocarbon well.

The method comprises calculating, at the local controller, optimal targets for one or more well parameters of the hydrocarbon well using measured values associated with operation of the hydrocarbon well. The optimal targets may be calculated by using past values (e.g. by regression or other techniques). For example, the optimal target for liquid production may be set by extrapolation of the targets in the previous cycles (e.g. of two cycles or from data of a day or of two or more days).

The method also comprises obtaining, at the local controller, a model that comprises a relationship between the operation of the gas injection choke and the operation of the production choke with the one or more well parameters. The model can be obtained based on the measurement values and received model parameters from the SCADA system based on operation data collected from the plurality of the hydrocarbon wells. For example, recent data (e.g. of a couple of cycles or hours or a day) can be used along with model parameters last communicated by the SCADA system for the model.

The model is used at the local controller for determining operating set points for control of at least one of the production choke and the gas injection choke to meet the optimal targets. Thereafter, the method comprises operating at least one of the production choke and the gas injection choke by the local controller with the determined operating set points for optimized production of the hydrocarbon well.

DRAWINGS

These and other features, aspects, and advantages of the present invention will become better understood when the following detailed description is read with reference to the accompanying drawings in which like reference numerals represent corresponding parts throughout the drawings, wherein.

DETAILED DESCRIPTION OF THE INVENTION

As used herein and in the claims, the singular forms "a," "an," and "the" include the plural reference unless the context clearly indicates otherwise.

Figure 1:
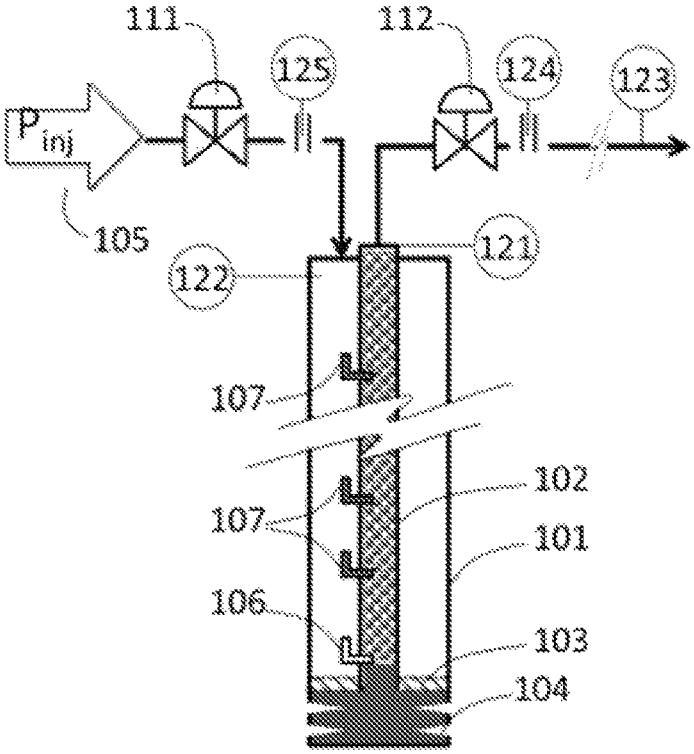
FIG. 1 is a diagrammatic representation of a gas lifted hydrocarbon well with multiple mandrel-valve assemblies.
Figure 2:
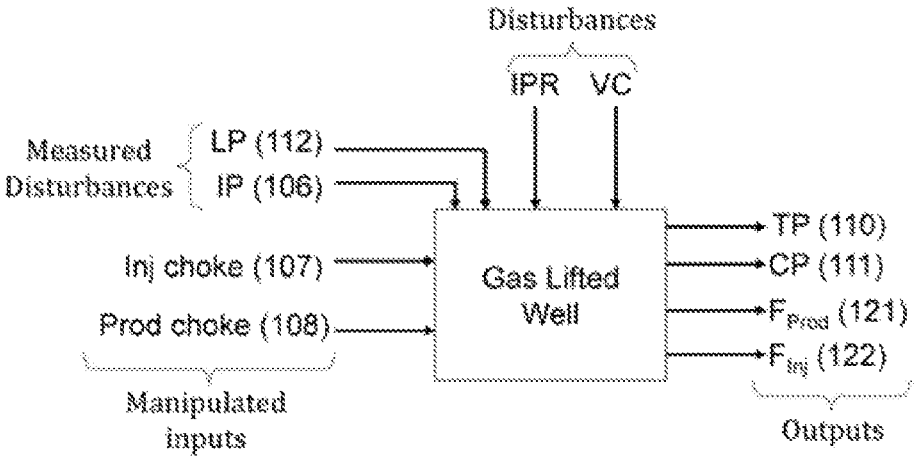
FIG. 2 is a block diagram for gas lifted hydrocarbon well.
Figure 3:
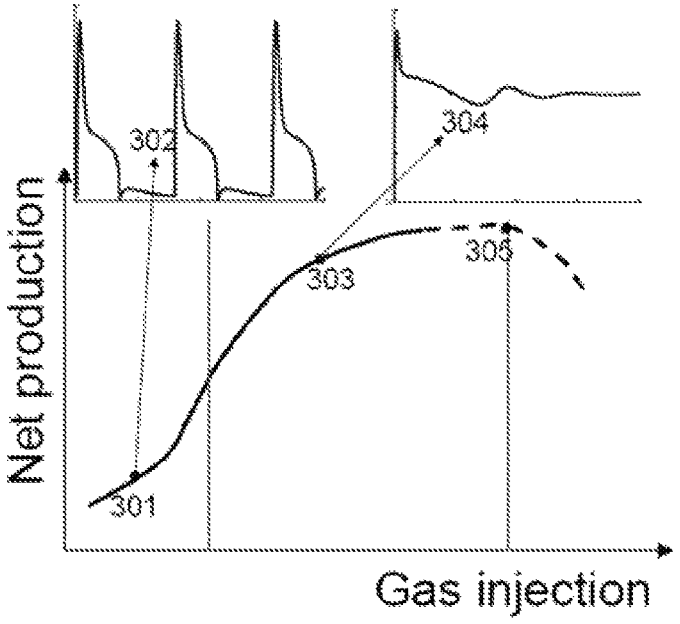
FIG. 3 is a graphical representation based on a mathematical model for net hydrocarbon production as a function of gas injection rate.

The hydrocarbon well is also referred herein as 'gas lifted hydrocarbon well' or 'well' or 'gas-lifted well'. FIG. 1-3 describe a typical gas-lifted hydrocarbon well and it's operation characteristics.

FIG. 1 illustrates a gas lifted well with multiple mandrel valve assemblies. It consists of an outer tube called casing 101 and an inner tube called tubing 102. The region between casing and tubing is called annulus. Various fluids from the reservoir flow into the well-bore through the perforations 104 at the bottom of the well. A gas-lifted well may be provided with a packer 103 to prevent the flow of liquids from the reservoir into the annulus. In gas lift operation, compressed gas at injection pressure Pinj 105, is injected at the top of the casing. A mandrel-valve assembly 106 is provided close to the bottom of the well. This valve (or alternatively, an orifice at the bottom) is the operating valve, which is open during normal operation of gas lifted well. Additionally, there are multiple mandrel-valve assemblies 107 along the height of the well, called unloading valves. All the unloading valves open at designed pressure at their location.

The following sensors and actuators are instrumented on the well described herein above. The injection choke (IC) 111 controls the amount of gas injected into the annulus, whereas production choke (PC) 112 regulates the production flow rate. The two flow rates are measured by flow meters 125 and 124, respectively. Finally, the tubing pressure (TP) 121, the casing pressure (CP) 122, production line pressure (LP) 123, production flow rate are also measured, at the surface.

The injected gas flows down the annulus, through one of the mandrel valves and bubbles into the liquid collected in the tubing. It thus allows de-liquefaction of the well, either by reducing the density of fluid column in the tubing and/or by providing additional energy for lifting the fluids. The tubing is connected through a production choke to a production line. Under normal operation, the unloading valves 107 are closed and the injected gas flows from the annulus into the tubing through the operating valve 106. During start-up, or when the liquid loads in the well, the unloading valves are operated to help efficient unloading of the liquid. Typically during unloading, one of the unloading valves is open.

The aim of gas lift is to efficiently remove liquids by injecting compressed gas into the well-bore, so that the production of hydrocarbon fluids from the reservoir can be maximized. The specific objectives of a gas lift control system are: avoiding oscillations or flow instability, maximizing hydrocarbon production, maximizing net profit, minimizing gas injection to attain desired production, or maintaining a desired operation of the well or a combination of these.

FIG. 2 is a block diagram representation of control parameters in the gas-lifted well of FIG. 1. The gas injection choke opening and/or production choke opening is controlled during the operation of the well. The well parameters include pressures in tubing and casing (annulus) at the surface (through pressure transducers 110 and 111) and production and injection flow rates (121 and 122, respectively). It will be understood by those skilled in the art that the well parameters will change with a change in operation of the gas injection choke and the production choke. Additionally, there will be disturbances such as line pressure (112) and injection pressure (106). Finally, the reservoir pressure—flow rate relationship (inflow performance relationship, IPR) and valve coefficient (VC) also occur that remain as unmeasured disturbances that affect gas lift. It may be noted here that a reasonable estimate of IPR and VC is assumed to be available through reservoir testing and from manufacturer, respectively. However, the actual values under operating conditions are difficult to obtain accurately.

Now turning to FIG. 3 that shows the results generated from a mathematical model of a gas-lifted well where the net hydrocarbon production is plotted against gas injection rate. The region to the left of the first vertical line (e.g., data-point 301) represents unstable flow region. The hydrocarbon production rate from point 301 is plotted with respect to time, and is shown as unstable hydrocarbon production, 302. When the gas injection rate is increased, the net production rate also increases. After certain time, a region of stable production (e.g., data-point 303) is reached, which is exemplified as stable hydrocarbon production, 304 as hydrocarbon production rate with time. Some wells will show an optimum production at point 305, after which further increase in gas production rate will result in a decrease in net production. Thus, point-305 represents the point of maximum hydrocarbon production.

It will be understood by those skilled in the art that the compression of gas and reinjection into the well for gas-lift is also associated with some cost. Hence, the point of maximum net profit (value of gas/oil produced minus the cost of reinjection) occurs somewhere in the region around the point shown in 304 and before the point shown in 305.

The curve in FIG. 3 is typically generated for constant values of all inputs and disturbances (with only injection choke opening varied). However, under operation, as the reservoir IPR changes and/or mandrel/valves or well equipment age, the curve in FIG. 3 will change.

Further, such curves represent long-term behavior of the well. In practice, significant transient changes in injection pressure, compressed gas availability and production line pressure may be expected. In yet another aspect, the invention ensures stable, trouble-free de-liquefaction by mitigating the effect of such transient disturbances.

The invention described herein provides a method for optimizing production of a hydrocarbon well implemented by a local controller (local computing device) by controlling the gas injection choke and the production choke, to handle these dynamic changes and to ensure optimal production in presence of such disturbances. The controller in one exemplary embodiment is configured to be implemented to be an integral part of a remote terminal unit (RTU) having limited computational power (i.e. RTU is functioning as the local controller), and addresses a practical challenge of communicating with the central control room that has a supervisory control and data acquisition system (SCADA) only intermittently. However, it should be noted that some functions (calculations) carried out by the local controller can also be implemented in SCADA i.e. a supervisory control and data acquisition system or DCS i.e. Distributed Control System or PLC i.e. Programmable Logic Controller or other such control system or embedded devices.

Figure 4:
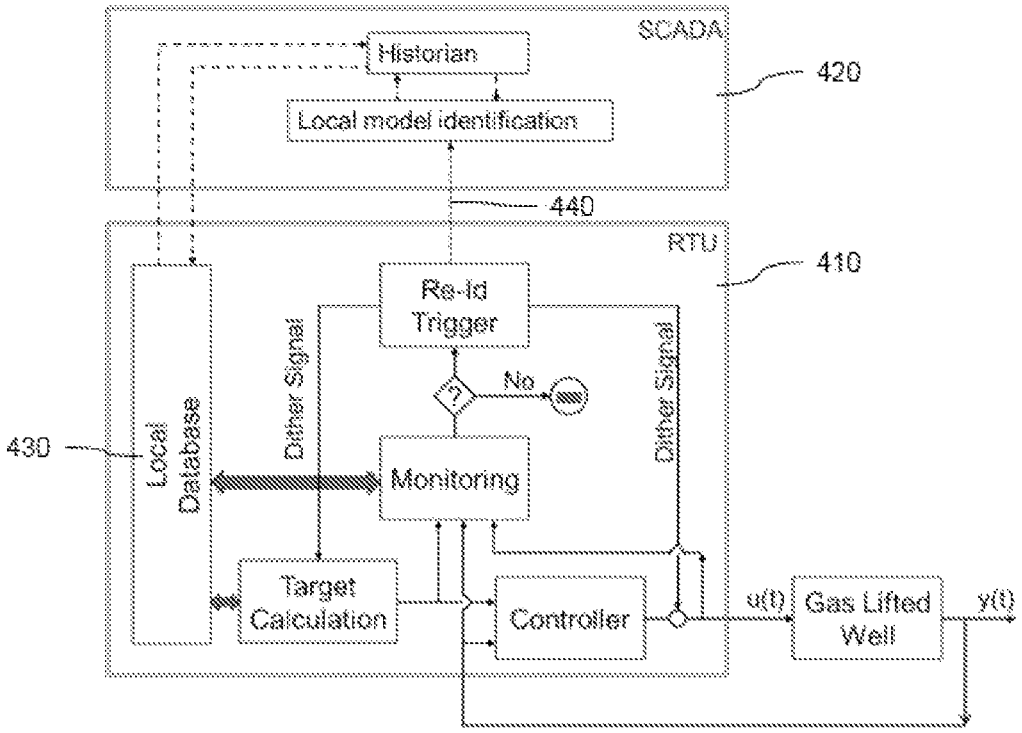
FIG. 4 is a block diagram representation for an exemplary control methodology of the invention.

FIG. 4 provides a block diagram representation for an exemplary control methodology of the invention. The figure depicts a RTU (410) and SCADA (420). The control method includes dynamically calculating optimal targets and target trajectories (forecasted values) for one or more well parameters using past data from the history of the operation of hydrocarbon well managed in the local database (430) of the RTU. The one or more well parameters such as injection flow, production flow, casing pressure, tubing pressure, turner multiplier (which decides how much more/less gas injected than the value calculated by turner flow rate) are used from the past few hours of data (e.g. 0.5-10 hr). In one exemplary implementation operation data i.e. measurement values for the well parameters and calculated parameters associated with operation of the well, for example two successive net profit values (net difference between cost of gas/oil produced and cost of reinjection) from the past data are used. This ensures that no heavy data loading is required at the controller and satisfies the reduced computation requirement at the local controller. These target calculations can be implementable on RTU or SCADA.

The controller (RTU) used to implement the method described herein is provided with a model data set (model) that comprises a relationship between an operation of the gas injection choke and an operation of the production choke with the measurement values for one or more well parameters from the past history of operation of the hydrocarbon well (obtained from the local database in the controller, also the local database contains updates from the SCADA system). The model also can consider operation of the mandrel valves as reflected by the measurement of the one or more well parameters or calculations reflecting the state of mandrel valves. In one implementation the model data set is a local linear dynamic model for the hydrocarbon well. The model data set is used to find values of the well parameters that satisfy the optimal targets, and control operation is then done using the gas injection choke and production choke operation details related to these values from the model. The control operation includes opening or closing of production choke and adjusting an amount of gas injection through the gas injection choke.

The method further includes a step for receiving control data (model parameters and/or set points) associated with the control operation and measurement data associated with the plurality of well parameters during the control operation by the controller from a SCADA system and communicating the control data and the measurement data by the controller to the SCADA system for updating the history of the operation of the hydrocarbon well. The periodic communication from the controller to SCADA serves as an automatic generation of a periodic trigger (440) for updating of the model data set on RTU. This periodic updating of the model data set is triggered when an error value between the optimal targets and actual measurements of the respective one or more well parameters after the control operation is beyond a pre-defined threshold value. This is further explained in more detail in the sections herein below.

In an exemplary implementation, the new model parameters are calculated on SCADA/DCS and communicated to the RTU in batch-wise fashion. The control instruction/function (control data) on RTU is updated periodically with new model parameters calculated in SCADA or using a new control instruction calculated on SCADA. Systematic method for batch-wise co-ordination between model and/or control instruction developed on the SCADA, controller setting in RTU and optimal targets calculated on the RTU is developed.

The method therefore also includes re-calculating optimal targets for the one or more of a plurality of well parameters using updated history of the operation of the hydrocarbon well. The method further includes using the updated model data set to control the operation of at least one of the production choke and the gas injection choke to meet the re-calculated optimal targets for the one or more of the plurality of well parameters.

It would be appreciated by those skilled in the art, that the method described herein ensures periodic updating of the model data set the optimal targets to ensure that the control operation of gas injection choke and the production choke is tuned for the dynamic changes of the well operation.

While the field conditions and constraints are the immediate challenges that are addressed by this method, the method is not limited to unconventional oil and gas wells. The similar method and systems may also be applied to conventional fields, as well as to well-instrumented systems (e.g. a hydrocarbon well with a high capability distributed control system).

Further details for better understanding of the method described herein above are provided below.

Calculation for optimal targets and target trajectories on RTU:

In general, one skilled in art would understand that the maximum oil and/or gas production is desired with least gas injection (i.e. maximum net profit). However, practically, it is difficult to know exact maxima and hence optimal operating point. Therefore to overcome this limitation, optimal target trajectories are calculated based on past data. In this context, an economic operating condition is condition at which maximum net profit can be achieved. Alternatively, one may also consider condition such that minimum gas injection rate at which stable operation is achieved e.g. point 303 in FIG. 3. These conditions are obtained using past data.

Consider an example where net profit is define as follows:

$$P_{net}=c_{oil}+c_{gas}-c_{inj} \quad (1)$$

where $c_{oil}$, $c_{gas}$ and $c_{inj}$ are total cost of produced oil, total cost of net gas produced and cost of energy require for total injected gas.

The method for obtaining optimal targets for gas injection flow and/or casing pressure and/or tubing pressure include qualitative comparison of net profit calculated over past two successive and relatively shorter time horizon (or window) with respect to trends of one or more of above mentioned targets. For example, let us assume moving average of injection flow openings in two successive time window are $F_{inj_{w1}}$ and $F_{inj_{w2}}$, respectively and corresponding net profit values are $P_{net_{w1}}$ and $P_{net_{w2}}$. These values are then used to decide injection flow for next time period as follows, $$F_{inj_{w3}} = F_{inj_{w2}} + \frac{\text{sign}(F_{inj_{w2}} - F_{inj_{w3}})}{\text{sign}(P_{net_{w2}} - P_{net_{w1}})} \times \Delta F_{inj} \quad (2)$$

Here $\Delta F_{inj}$ can be fixed value or it can be calculated based on rate of change in net profit value vs rate of change of injection flow during two successive time windows. Similarly, optimal target values for casing pressure, tubing pressure, turner multiplier are obtained. Note that these optimal targets are calculated on the RTU but at a relatively smaller frequency than the frequency for which the controller is designed. For example, if a controller on RTU is designed for 1 min sampling time then probably targets can be calculated at every 10 min using past 1 hr data.

For simplification, equation 2 considers target calculation of a single variable. However, it is not restricted to a single variable or well parameter, and similar approach can be taken to calculate target for all other variables or well parameters. Moreover, it explains use of one technique for calculating optimal targets using past data. However, another equivalent technique such as regression techniques between target variable and net profit can also be used to update optimal target values, periodically.

In order to achieve these optimal targets, the controller setting on the RTU has to manipulate production choke and/or injection choke accordingly.

The next section describes about efficient control instructions that can be implemented on the RTU in an exemplary implementation.

Control instructions on RTU:

Practically achievable optimal targets are obtained as in the previous section. Now the control instructions are developed that need to be adopted to achieve these targets under uncertain gas well dynamics due to change in bottom-hole conditions, variations in sales line pressure, etc. The proposed control instructions use a model (e.g. data-based local linear model) that relates gas injection and/or production choke openings (or flow) with one or more of the casing pressure, tubing pressure, amount of liquid production, amount of the gas injection and sales line pressure. This model, obtained at the RTU, is able to predict local behavior of well dynamics, hence is used to develop controller such as PID or other such controller. This controller is then used to arrive at an optimal opening of production and/or gas injection choke that meets the optimal targets calculated in the previous section.

Here it should be noted that the controller using the local linear model will be able to track the optimal targets as per expectation until underline local model closely represent current well dynamics. Thus, the control policy developed based on local linear model will not be good enough to achieve set optimal targets after certain time period because of mismatch between model and actual well dynamics. This calls for a need of updating of the model data set i.e. the local linear model in this case, this is also referred herein as re-identification of the model. Further, since the re-identification is a computationally expensive task, it needs to be performed offline on the SCADA and therefrom the model is obtained from the SCADA. On the other hand, due to unavailability of continuous connectivity between SCADA and RTU it is not possible to re-identify model very frequently. Thus, one needs to update the model periodically based on a systematic technique, which is discussed next.

Automatic periodic trigger for re-identification and test signal generation on RTU:

As discussed above it is important to trigger for re-identification i.e. updation of the model or model data set periodically to avoid significant mismatch between local linear model and actual well dynamics. Moreover, this trigger has to be initiated from RTU. For this, the method involves a step for calculating an error value between the optimal targets and actual measurements of the one or more well parameters after the control operation. The update of model is automatically triggered when the error value crosses a pre-defined threshold value. A trend in error values may also be monitored, and the automatic trigger may be based on a cut-off threshold value for the trend.

Once the re-identification is triggered, automatic dither signals consisting of few step changes in positive and negative direction are introduced for the optimal targets or for changing the production choke and/or gas injection choke from their current value, for relatively small time period e.g. positive step change for 3 period followed by negative step change for 2 period and repeat similar cycles for 2-3 times. The data collected after the re-identification trigger along with nominal data collected after injection of dither is then sent to the SCADA during next batch (e.g. at the end of current hour) and controller continues to use current model for next one batch (e.g. for next hour).

Re-identification of local linear model and/or redesign of controller on SCADA.

The batch of data received from the RTU after re-identification trigger and after injection of dither signals are used to re-identify or update the local linear model keeping structure of model similar to previous local linear model. The new model parameters are then pushed to the RTU during exchange of next batch, which will be used to update the model in the controller on the RTU. Alternatively, one can also re-identify model of different structure and update the control instruction on the SCADA itself and final control instruction can be pushed to the RTU during exchange of next batch. The new control instruction is activated as soon as it is pushed to the RTU to decide production choke and/or injection choke manipulation more accurately.

Some key advantageous features of the above referenced method include automatic trigger for model and optimal target update, which is implementable on the RTU, method for efficient periodic model identification under limitation of connectivity between SCADA and RTU, use of periodically updated model to update control operation on the RTU, obtaining practically achievable optimal targets trajectories based on past data which is implementable on the RTU and integrating these targets into RTU based control instructions.

In one other aspect, the method also provides an estimate of whether the well has loaded requiring a switch from operating to unloading mode to allow the de-liquefaction as explained earlier. Such a method is executable on the remote terminal unit (RTU) or equivalent controller.

Thus the method includes a step for determining switching from an operating mode to an unloading mode, wherein the operating mode is associated with opening of an operating valve in the well during production of hydrocarbon from the well, and wherein unloading mode is associated with opening of one or more unloading valves from a plurality of unloading valves along a height in the hydrocarbon well, and wherein the determination is used for controlling amount of gas injected from gas injection choke.

The switching from the operating mode to the unloading mode is determined based on at least one of a liquid level in an annulus of the hydrocarbon well, annulus pressure at the plurality of unloading valves, and mass of gas in the annulus. This is further explained in more detail herein below:

The RTU-based determination of switching is based on the following approach:

The pressure in annulus in any location at the depth h from the surface is calculated using the casing pressure, $P_c$ as follows:

$$P_a(h) = P_c \exp\left(\frac{Mg}{zRT}h\right)$$

Where, Mg is the molecular weight of the injected gas, R is the ideal gas constant, T is the absolute temperature, z is the compressibility factor.

If H is the total depth of the well, and $L_a$ is the height of liquid column in the annulus, then $$P_a(h) = P_c \exp\left(\frac{Mg}{zRT}(H - L_a)\right) + \rho_{liq} g(h - (H - L_a))$$

The casing pressure $P_c$ is measured (by 122) at each time instant. Using the measurement, the pressures along the depth of the annulus can be calculated. The calculated pressures are then compared with the designed operating pressures for each mandrel. If the calculated value of $P_a(h=h_{mandrel\ i})$ is within its designed operating pressure, that mandrel opens.

Calculating the annulus pressure at various mandrel depths and based the open valve condition described above, the opened mandrel valve can be identified. At this stage a second check is executed as next step.

As a next step, the mass of gas in the annulus can be calculated by the following equation:

$$m_{g,ann} = A_{ann} \frac{P_c - P_a(H - L_a)}{g}$$

Where $\dot{m}_{g,ann}$ is the mass of gas in the annulus, and $A_{ann}$ is the cross-sectional area of the annulus.

Using the history of casing pressures data, the mass of gas in the annulus vs. time can be estimated. A mass flow rate of gas injected in the annulus is also measured. The gas enters annulus through the gas injection choke and leaves annulus through the unloading/operating valve. The history of $\dot{m}_{g,ann}$ can be used to calculate the rate of change of mass in the annulus. Thus, $$\dot{m}_g = \frac{\Delta m_{g,ann}(t)}{\Delta t}$$

If $(F_{inj}-\dot{m}_g)\leq 0$, then it means that all the gas injected in the annulus accumulated in the annulus. This may happen because (i) the operating valve has closed; (ii) pressure on tubing side exceeds that on annulus, resulting in no flow; or (iii) liquid level in annulus goes above the operating valve. Note that item (iii) is a conservative estimate, since higher liquid level will only increase $\dot{m}_g$.

To decide on a controller operation, if any of the unloading valves (107) are open, or if the gas is unable to flow into the tubing, the controller switches from operating to unloading controller. Else if, the operating valve (106) is open the controller works in regular operating mode (production mode).

Model-Based Estimation and Detection of Mode Shift

In the model-based estimation, we use dynamical model of the gas and liquid flow in the vertical well. The model accounts for mass of gas in annulus, mass of liquid in annulus, mass of gas in tubing and mass of liquid in tubing and is based on the following understanding of the operation of the hydrocarbon well.

The gas enters the annulus when it is injected into the system and leaves the annulus through either the operating or unloading valve. The gas from annulus enters the tubing through any of the mandrel valves, as well as from the reservoir. The gas leaves the tubing through the production choke. The liquid enters the tubing from the annulus and from the reservoir, and leaves the tubing from the production choke. Based on the above assumption, a simplistic model equations are presented as example (see FIG. 2 for block diagram representation of a gas lifted well model).

$$\frac{d}{dt}\begin{bmatrix} m_{ga} \\ m_{La} \\ m_{gt} \\ m_{Lt} \end{bmatrix} = \begin{bmatrix} F_{inj} - \Sigma w_j \\ -w_1 \\ F_{res} + \Sigma w_j - xF_{prod} \\ F_{res}/GLR + w_1 - (1-x)F_{prod} \end{bmatrix}$$

In the above model, $F_{inj}$ is injection flow rate, $F_{res}$ is flow rate from the reservoir (obtained from Inflow Performance Relationship or IPR curve), $w_j$ are mass flow rates from the $j^{th}$ mandrel valve, $F_{prod}$ is production flow rate, GLR is gas-to-liquid ratio of the reservoir and $x=m_g/(m_g+m_l)$ is the mass fraction.

A state estimator, such as Kalman filter, extended Kalman filter or Moving Horizon Estimator can be used to estimate the unmeasured model states and correct for the effect of disturbances on the overall model behavior. At each time, the model calculated predicted values of the states, and estimator corrects these values based on measured outputs.

Once the states are known, equations similar to RTU based approach are used to obtain liquid level in annulus, pressure along entire annulus height and pressure along entire tubing height. Calculating the annulus pressure at various mandrel depths and based the open valve condition, the opened mandrel valve can be identified. If the annulus pressure exceeds pressure of opening of the unloading valve (at least one, or more), and if the tubing pressure is less than annulus pressure at that location, then the flow of gas happens through the valve.

If such a situation is detected, the uppermost unloading valve that satisfies the above condition is flagged as the current unloading valve and the controller switches into unloading mode. If none of the unloading valves are open, the controller stays in operating mode.

The abovementioned determinations regarding the mandrel valves is performed at the SCADA system as per the models described hereinabove and the output from the SCADA system is used for optimizing production of the hydrocarbon well.

Thus the method of the invention additionally optimizes gas injection by determination of the operating and unloading modes of the operating valve and the unloading valves. The method can also trigger manual mode upon detection of operation of an unloading valve. Such a trigger would assist in early identification and resolution of faulty situations in the well.

Figure 5:
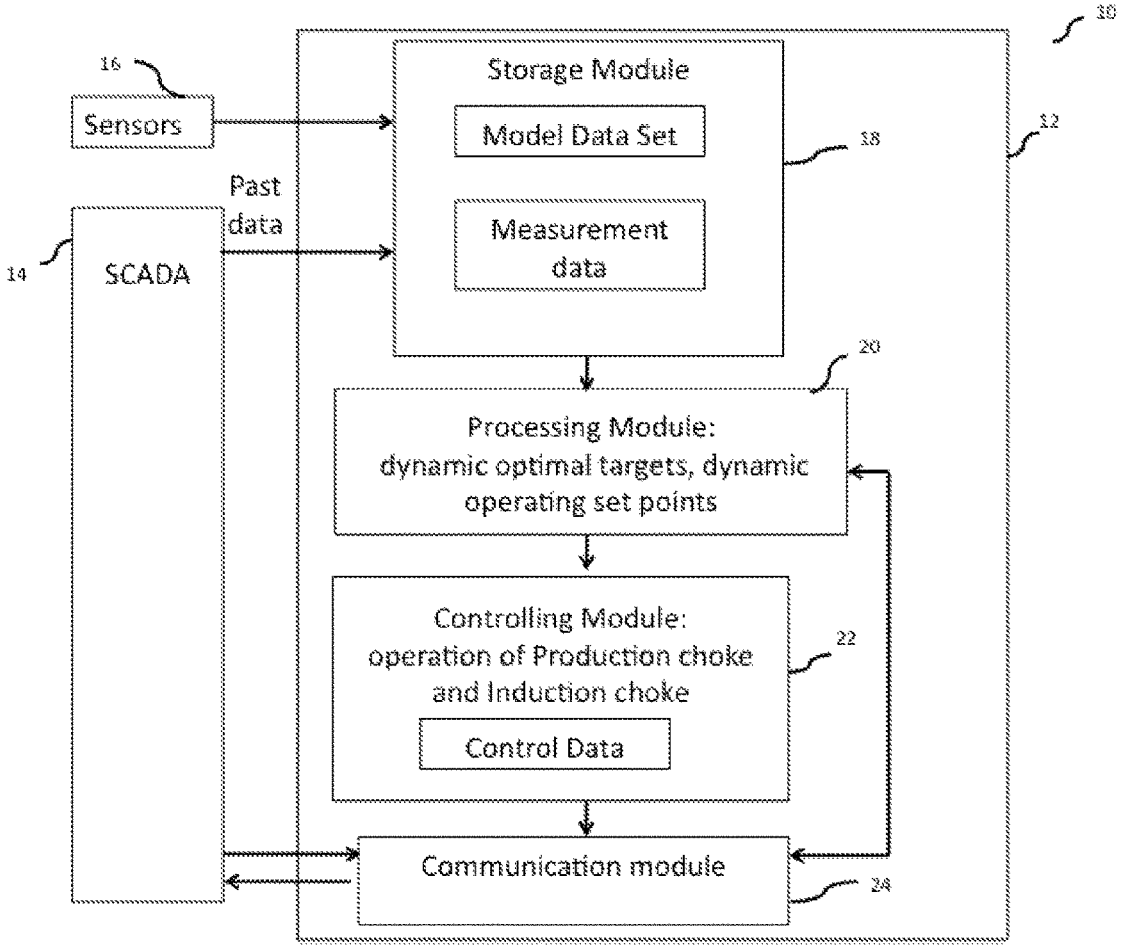
FIG. 5 is a block diagram representations showing exemplary modules for the control system, controller and SCADA according to one aspect of the invention.

FIG. 5 is an exemplary block diagram of a control system 10, including local controller 12 and a supervisory control and data acquisition (SCADA) 14 used for optimizing production of a hydrocarbon well, wherein the hydrocarbon well is monitored using SCADA system. The control system comprises sensors 16 to measure different well parameters as described herein above. The exemplary sensors include casing pressure sensor, tubing pressure sensor, line pressure sensor, flow rate sensor, arrival sensor, injection pressure sensor, and injection flow rate sensor.

The controller 12 is used for controlling an operation of at least one of the production choke and the gas injection choke, and for communicating with SCADA. The controller 12 includes a storage module 18 (local database) that receives past history (past data) of operation of the hydrocarbon well, a model data set that is representative of a relationship between an operation of the gas injection choke and an operation of the production choke, and measurement values for one or more well parameters from the past data.

The controller 12 further includes a processing module 20 for calculating optimal targets for one or more of the plurality of well parameters, using the measurement values for the one or more operating parameters associated with at least two successive net profit values for production of hydrocarbon (i.e. value associated with operation of the well) from the hydrocarbon well from the past data, and for using the model data to obtain operating set points for the production choke and the gas injection choke that meet the optimal targets.

The controller 12 also includes a controlling module 22 to control operation of at least one of the production choke and the gas injection choke based on the operating set points. The control data associated with the operating set points and measurement data associated with the plurality of well parameters during the control operation by the controller is received by the storage module 18 from the controller and sensors 16 respectively.

The controller 12 also includes a communication module 24 for communicating the control data and the measurement data by the controller 12 to SCADA 14 for updating the history of the operation of the hydrocarbon well in SCADA, for sending a periodic trigger to update the model data set and to receive data from SCADA for periodically updating the model data set.

The processing module 20 is further configured for re-calculating optimal targets for the one or more of a plurality of well parameters using updated history of the operation (from the local database obtained from measurements and from SCADA system) of the hydrocarbon well and using the updated model data set to control the operation of at least one of the production choke and the gas injection choke to meet the re-calculated optimal targets for the one or more of the plurality of well parameters.

As described herein above in reference with the method of invention, the control operation comprises at least one of opening of production choke, closing of production choke and amount of gas injection through the gas injection choke.

The processing module 20 is still further configured in one implementation, for determining switching from an operating mode to an unloading mode, where the operating mode is associated with opening of an operating valve in the well during production of hydrocarbon from the well, and wherein unloading mode is associated with opening of one or more unloading valves from multiple unloading valves, also referred herein as mandrel valves, along a height in the hydrocarbon well. This determination is used for controlling amount of gas injected from gas injection choke.

The control system, controller and the method described herein above address the dynamic changes in a gas-lifted hydrocarbon well during the operation of the hydrocarbon well and at the same time meet the optimal targets to optimize the production from the well.

The described embodiments may be implemented as a system, method, apparatus or non transitory article of manufacture using standard programming and engineering techniques related to software, firmware, hardware, or any combination thereof. The described operations may be implemented as code maintained in a "non-transitory computer readable medium", where a processor may read and execute the code from the computer readable medium. The "article of manufacture" comprises computer readable medium, hardware logic, or transmission signals in which code may be implemented. Of course, those skilled in the art will recognize that many modifications may be made to this configuration without departing from the scope of the present invention, and that the article of manufacture may comprise suitable information bearing medium known in the art.

A computer program code for carrying out operations or functions or logic or algorithms for aspects of the present invention may be written in any combination of one or more programming languages which are either already in use or may be developed in future on a non transitory memory or any computing device.

The different modules referred herein may use a data storage unit or data storage device which are non transitory in nature. A computer network may be used for allowing interaction between two or more electronic devices or modules, and includes any form of inter/intra enterprise environment such as the world wide web, Local Area Network (LAN), Wide Area Network (WAN), Storage Area Network (SAN) or any form of Intranet, or any industry specific communication environment.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for optimizing production of a hydrocarbon well with a local controller in communication with a supervisory control and data acquisition (SCADA) system, the SCADA system monitoring a plurality of hydrocarbon wells and acquiring operation data of the hydrocarbon well from the local controller for optimizing production of the hydrocarbon well, wherein the hydrocarbon well comprises a production choke to control production of hydrocarbon from the hydrocarbon well, and a gas injection choke to control gas injection in an annulus of the hydrocarbon well, the method comprising:

calculating, at the local controller, targets for one or more well parameters of the hydrocarbon well using measured values associated with operation of the hydrocarbon well;

obtaining, at the local controller, a model that comprises a relationship between the operation of the gas injection choke and the operation of the production choke with the one or more well parameters based on the measurement values and received model parameters from the SCADA system based on operation data collected from the plurality of the hydrocarbon wells;

determining, at the local controller, operating set points for control of at least one of the production choke and the gas injection choke to meet the targets, wherein the operating set points are determined based on the model; and operating at least one of the production choke and the gas injection choke by the local controller with the determined operating set points for optimized production of the hydrocarbon well.

2. The method of claim 1, wherein the one or more well parameters comprise injection flow, production flow, casing pressure, and tubing pressure.

3. The method of claim 1, wherein the operation data and the one or more well parameters are obtained from the local controller and from a plurality of sensors placed in the hydrocarbon well respectively.

4. The method of claim 1, wherein operating at least one of the production choke and the gas injection choke by the local controller includes a control operation comprising at least one of opening the production choke, closing the production choke and controlling an amount of gas injection through the gas injection choke.

5. The method of claim 1, wherein the model parameters of the model in the local controller are updated based on a trigger generated at the local controller for the SCADA system when an error value between the targets and actual measurements of the respective one or more well parameters after a control operation is beyond a pre-defined threshold value.

6. The method of claim 1, further comprising determining switching from an operating mode to an unloading mode, wherein the operating mode is associated with opening of an operating valve in the hydrocarbon well during production of hydrocarbon from the hydrocarbon well, wherein the unloading mode is associated with opening of one or more unloading valves from a plurality of unloading valves along a height in the hydrocarbon well, and wherein the determination is used for controlling an amount of gas injected from the gas injection choke.

7. The method of claim 6, wherein determining switching from the operating mode to the unloading mode is based on at least one of a liquid level in the annulus of the hydrocarbon well, annulus pressure at the plurality of unloading valves, and a mass of gas in the annulus.

8. A local controller for controlling an operation of at least one of the production choke and the gas injection choke of a hydrocarbon well, the local controller in communication with a supervisory control and data acquisition (SCADA) system that monitors a plurality of hydrocarbon wells, the local controller comprising:

a local database comprising operation data of the hydrocarbon well and model parameters of a model depicting a relationship between an operation of the gas injection choke and an operation of the production choke with measured values of the one or more well parameters from the plurality of the well parameters;

a processing module for calculating targets for one or more of the plurality of well parameters using the operation data in the local database and for using the model to obtain operating set points for the production choke and the gas injection choke to meet the targets;

a controlling module to control operation of at least one of the production choke and the gas injection choke based on the operating set points; and a communication module for communicating with the SCADA system including sending a trigger to update the model parameters in the local database;

wherein the model parameters of the model are updated from the past measurements of the one or more of the plurality of well parameters and the communication received from the SCADA system; and wherein the updated model parameters are used for calculating the targets for the one or more of the plurality of well parameters in the processing module.

9. The local controller of claim 8, wherein the processing module is further configured for determining switching from an operating mode to an unloading mode, wherein the operating mode is associated with opening of an operating valve in the hydrocarbon well during production of hydrocarbon from the hydrocarbon well, wherein the unloading mode is associated with opening of one or more unloading valves from a plurality of unloading valves along a height in the hydrocarbon well, and wherein the determination is used for controlling an amount of gas injected from the gas injection choke.

* * * * *